US010704749B2

(12) United States Patent
Schulz et al.

(10) Patent No.: US 10,704,749 B2
(45) Date of Patent: Jul. 7, 2020

(54) LAMP

(71) Applicant: LICHT KUNST LICHT AG, Bonn (DE)

(72) Inventors: Andreas Schulz, Bonn (DE); Thomas Möritz, Köln (DE); Till Armbrüster, Bonn (DE)

(73) Assignee: LICHT KUNST LICHT AG, Bonn (DE)

( * ) Notice: Subject to any disclaimer, the term of this patent is extended or adjusted under 35 U.S.C. 154(b) by 0 days.

(21) Appl. No.: 16/465,826

(22) PCT Filed: Dec. 8, 2017

(86) PCT No.: PCT/EP2017/082063
§ 371 (c)(1),
(2) Date: May 31, 2019

(87) PCT Pub. No.: WO2018/108745
PCT Pub. Date: Jun. 21, 2018

(65) Prior Publication Data

US 2019/0301690 A1 Oct. 3, 2019

(30) Foreign Application Priority Data

Dec. 13, 2016 (DE) ..... 10 2016 124 257

(51) Int. Cl.
*F21V 21/00* (2006.01)
*F21S 6/00* (2006.01)
(Continued)

(52) U.S. Cl.
CPC ..... *F21S 6/002* (2013.01); *F21S 6/008* (2013.01); *F21V 7/0016* (2013.01);
(Continued)

(58) Field of Classification Search
CPC ..... F21S 6/002; F21S 6/008; F21V 7/0016; F21V 7/0083; F21V 21/30;
(Continued)

(56) References Cited

U.S. PATENT DOCUMENTS 9,220,147 B2 * 12/2015 Newton ..... H05B 47/105
2017/0307151 A1 * 10/2017 Deng ..... F21S 6/003

FOREIGN PATENT DOCUMENTS

DE 10 2009 017163 B3 10/2010
EP 2 392 854 A2 12/2011

OTHER PUBLICATIONS

European Patent Office, English language version of the International Search Report, Form PCT/ISA/210 for International Application PCT/EP2017/082063 (2 pages).

* cited by examiner

*Primary Examiner* — Laura K Tso
(74) *Attorney, Agent, or Firm* — Pauley Erickson & Kottis

(57) ABSTRACT

A luminaire including a luminaire base, a luminaire head and a luminaire stand extending between the luminaire base and the luminaire head, wherein the luminaire head includes first illuminants, which are arranged in a common plane, and which are adapted to extract a first, indirect fraction of light, and wherein the luminaire head includes a glare suppression arrangement, which is arranged in parallel to the plane, and includes a light-directing foil and shielding elements, wherein the shielding elements are arranged so that a beam spread of the indirect fraction of light after passage through the glare suppression arrangement is limited to 30° with respect to a vertical to the plane, and wherein the glare suppression arrangement in the direction of the vertical has a maximum height of 2.0 cm.

28 Claims, 3 Drawing Sheets

(51) Int. Cl.

| | |
|---|---|
| *F21Y 105/10* | (2016.01) |
| *F21Y 115/10* | (2016.01) |
| *F21V 7/00* | (2006.01) |
| *F21V 21/30* | (2006.01) |
| *F21V 23/04* | (2006.01) |

(52) U.S. Cl.
CPC ..... *F21V 7/0083* (2013.01); *F21V 21/30* (2013.01); *F21V 23/0435* (2013.01); *F21V 23/0471* (2013.01); *F21Y 2105/10* (2016.08); *F21Y 2115/10* (2016.08)

(58) Field of Classification Search
CPC ..... F21V 23/0435; F21V 23/0471; F21Y 2105/10; F21Y 2115/10
USPC ..... 362/33, 240, 241, 242, 243, 247, 248, 362/249.07, 249.09, 249.1, 413, 414
See application file for complete search history.

LAMP

BACKGROUND OF THE INVENTION

Field of the Invention

This invention relates to a luminaire, including a luminaire base, a luminaire head and a luminaire stand extending between the luminaire base and the luminaire head, and the luminaire head includes first illuminants, which are arranged in a common plane, and which are adapted to extract a first, indirect fraction of light, and the luminaire head includes a glare suppression arrangement.

Discussion of Related Art

The terms "indirect fraction of light" and "direct fraction of light" are understood as follows within the meaning of this invention: a direct fraction of light is a fraction of light, the light of which is directed directly to an area of the room to be illuminated, for example, a workplace. An indirect fraction of light illuminates the room indirectly, via a reflection of light, for example, on walls or ceilings of a room. For example, in a room the light is radiated upwards in the direction of the ceiling of the room and/or sidewards onto the walls of the room, and from there reflected into the room, in particular on a workplace.

For illuminating offices and open-plan offices, often a combination of ceiling-mounted luminaires or free-standing luminaires as well individual table luminaires are used. Here, the ceiling-mounted luminaires or free-standing luminaires serve for a general illumination of the room, while the table luminaires provide sufficient selective illumination of the individual workplace. Here, the number of different light horizons are often considered to be disadvantageous which light horizons occur due to the different radiation planes of the individual luminaires. Another disadvantage is the lack of flexibility of static ceiling luminaires.

In particular in modern office structures, workplaces are often used in a very flexible and dynamic manner. Thus, on large tables or workbenches, working groups of different sizes get together or small, modular table systems are arranged into different working zones depending on the requirements. In that case, ceiling-mounted or wall-mounted luminaires due to their fixed installation do not permit any adjustment to variable workplace situations. Conventional desk luminaires can be positioned individually but only serve for illumination of the individual workplace and not for room lighting. It is generally cumbersome to position free-standing luminaires, which can be designed, for example, as uplights for indirect room illumination, always in a different location due to their size and the associated weight, and notwithstanding the above, they must combined with individual work luminaires so that several different light horizons are perceived as a result.

SUMMARY OF THE INVENTION

It is one object of this invention to provide a luminaire, in particular a table luminaire, which is suitable for extracting an indirect fraction of light for illumination of the workplace, which at the same time can be handled in an extremely mobile and flexible manner, and which can be positioned at a desired location by a user in a simple manner and without great effort, wherein the luminaire also complies with the requirements of a sophisticated, delicate design.

This object and others are achieved by a luminaire with the features described in this specification and in the claims. Specific embodiments and developments of this invention are described by the dependent claims.

This invention relates to a luminaire, including a luminaire base, a luminaire head and a luminaire stand extending between the luminaire base and the luminaire head, wherein the luminaire head includes first illuminants, which are arranged in a common plane E, and which are adapted to extract a first, indirect fraction of light, and wherein the luminaire head also includes a glare suppression arrangement arranged in parallel to the plane E, and which comprises a light-directing foil and shielding elements, wherein the shielding elements are arranged so that a beam spread of the indirect fraction of light after passage through the glare suppression arrangement is limited to 30° with respect to a vertical V to the plane E, and wherein the glare suppression arrangement in the direction of the vertical V has a maximum height of 2.0 cm.

In other words, the luminaire according to this invention has a special, extremely flat glare suppression arrangement through which the light emitted by the first illuminants is transmitted, and by which the beam spread of the indirect fraction of light is limited to 30° with respect to a vertical to the plane E. Insofar as the plane E is aligned in parallel to the ceiling of a room, the indirect fraction of light is radiated upwards in the direction of the ceiling, and the beam spread is limited to 30° with respect to the vertical in the room. Due to such a narrow beam spread, glare of standing persons is prevented, even if the luminaire according to this invention, for example, as a table luminaire, extracts the indirect fraction of light below the eye level of a standing person.

The glare suppression arrangement includes a light-directing foil and shielding elements. A light-directing foil is, for example, a micro-structured foil which filters the light transmitted, wherein the light beams pass through the foil within an angle predetermined by the specific foil structure, whereas light beams outside the angular range are reflected. The reflected light beams are also reflected by a housing of the luminaire head and thus strike the foil again. In this way, efficient influencing of the beam spread is possible.

But after passage through the light-directing foil, in addition to the fraction of light radiated in a desired angular range, further fractions of light radiated under very flat angles of approximately 70° with respect to the vertical V remain. In order to eliminate the flatly radiated fractions of light, the glare suppression arrangement includes shielding elements, which are arranged in the direction of the exit of light subsequent to the foil. The shielding elements are configured and arranged so that they let pass unimpeded the fraction of light radiated into the desired angular range, while mechanically shielding the fractions of light radiated under flat angles. The shielding elements can, for example, be formed as a grid arrangement located on the foil and made of interconnected webs each with a triangular cross section. Depending on the application, also other cross-sectional shapes of the webs are possible, for example, an ellipsoidal or parabolic cross-sectional shape. The shielding elements can, for example, be made of a plastic material or of metal, and they can stand on the foil as a grid arrangement, and, if applicable, be connected with the foil, for example, by adhering. The height of the shielding elements may be only a few mm, for example, 5 to 7 mm, wherein the specific height must be such that the fractions of light radiated under flat angles are entirely shielded.

Hence, the design within the luminaire head has several parallel planes. The first illuminants are arranged in a first plane E, for example, on a common circuit board. At a short distance of approx. 0.5 up to 4 mm, preferably of approx. 0.5 to 2 mm from the first illuminants, in the direction of the exit of light subsequent and in parallel to the plane E, the light-directing foil is arranged which covers the first illuminants. The shielding elements are finally arranged in another plane in parallel to the plane E and to the foil and subsequent to the foil. Here, the shielding elements can be arranged directly on the foil or at a short distance from the foil. Thus, the foil is located between the first illuminants and the shielding elements. Light radiated from the first illuminants at first passes through the foil and subsequently passes through the arrangement of the shielding elements. After passage through the glare suppression arrangement, the beam spread of the first, indirect fraction of light is limited to 30° with respect to a vertical V to the plane E.

Due to the special glare suppression arrangement and the associated radiation of the first indirect fraction of light into a defined, narrow angular range it is possible to position the luminaire head far lower in the room than it is the case for a conventional free-standing luminaire radiated upwards. In particular, the luminaire head can be arranged at a height between approximately 1.20 m and 1.70 m above a floor and/or at a height between approximately 0.40 m and 1.00 m above a table top, and thus at a height which is generally below the eye level of a standing viewer. The glare suppression arrangement according to this invention ensures that a viewer despite the high light output of the luminaire, which can, for example, be designed for an illumination of a workplace according to the standard DIN EN 12464/1, is not dazzled. In this way, it is possible to design the entire luminaire much smaller and more delicate than corresponding known luminaires used for room illumination which due to lacking or insufficient glare suppression mechanisms must extract the light above head and/or eye level of a viewer. In particular, the luminaire can be designed as a table luminaire radiating upwards with dimensions similar to that of a conventional desk lamp. When taking, for example, an approximately cuboid shape as a basis, the luminaire head can, for example, have a length between approximately 20 cm and 40 cm, preferably a length of approximately 32 cm, and a width between 20 cm and 30 cm, preferably a width of approximately 24 cm. Such a small luminaire is extremely mobile and can be put in most different positions in the room without any great effort.

At the same time, the glare suppression arrangement according to this invention is designed in an extremely flat manner so that the luminaire head of the luminaire can likewise be of a very flat design, and thus satisfies the requirements of a reduced design frequently requested today. Thus, it differs fundamentally from conventional luminaire heads as they are known, for example, from uplights in which a shielding is often bowl-shaped and thus far more voluminous in order to achieve a corresponding glare suppression effect at the same light output. Known, flat uplights in turn have only insufficient glare suppression mechanisms and can reasonably extract the light correspondingly only above the head level.

With the luminaire according to this invention a powerful, glare-free extraction of a strong, indirect fraction of light below the eye level of a standing viewer is possible, wherein the first illuminants used can be suitable for generating an illuminance of approximately 300 Lux at a workplace. The first illuminants can, for example, be LEDs which are arranged on a common, flat circuit board defining plane E.

A luminaire configured in such a way can adjust itself to most different office situations, and due to its small dimensions and the flat design of the luminaire head it has a very aesthetic overall appearance which satisfies modern design standards.

The luminaire according to this invention can be used not only as an office luminaire but also as a luminaire, for example, in a living room, a bedroom or any other room, in particular also in a home office.

One embodiment of this invention provides for the fact that the beam spread of the indirect fraction of light after passage through the glare suppression arrangement is limited to 22° with respect to a vertical V to plane E. It can be provided that the beam spread of the indirect fraction of light after passage through the glare suppression arrangement is limited to even smaller angles, for example, 20° with respect to the vertical V.

Also, it can be provided that the glare suppression arrangement in the direction of the vertical V has a maximum height of 0.8 cm or a maximum height of only 0.6 cm. An even more flat design of the luminaire head is possible as a result which design can be in particular cuboid-shaped.

According to one embodiment of this invention, each first illuminant is arranged in a mixing chamber. Within the meaning of this invention, a mixing chamber is an arrangement made of a highly reflective material, for example, of a highly reflective plastic material which laterally surrounds one or several illuminants. Radiation emitted from the first illuminants, which does not strike the light-directing foil in the angular range predetermined by the foil structure, and thus cannot pass through the foil, is reflected by the light-directing foil, as explained above, and now strikes the highly reflective material of the mixing chamber. Here, the radiation is likewise reflected once or several times, and finally under a different angle strikes the light-directing foil again and can pass through it now, if the radiation is now within the angular range provided. Otherwise, the radiation is continued to be reflected between the light-directing foil and the mixing chamber until it finally strikes the foil in the angular range provided and can pass through it. Thus, the provision of a mixing chamber results in the fact that hardly any radiation escapes on the sides by reflection effects and is lost which is accompanied by an increase in efficiency of the luminaire.

According to an embodiment of this invention, the luminaire head of the luminaire includes second illuminants for extracting a second, direct fraction of light. In other words, it can be provided that the luminaire according to this invention includes not only first illuminants for extracting a first, indirect fraction of light for illumination of a room but also second illuminants by which a second, direct fraction of light can be extracted. Here, the direct fraction of light generally serves for increased illumination of an individual workplace. Here, the first and second illuminants can be made so that an illuminance of approximately 500 Lux in total is achieved on the workplace which is composed of the illuminance of approximately 300 Lux in the room brought about by the indirect fraction of light as well as the illuminance on the workplace itself brought about in addition by the direct fraction of light. Thus, the luminaire according to this invention assumes not only the task of illumination of the room but also that of illumination of the workplace, and thus combines in one luminaire the properties of conventional, ceiling-mounted luminaires and/or free-standing luminaires and of traditional desk luminaires. In its manageability, the luminaire is comparable to a traditional desk luminaire here, and thus can be repositioned differently time and again without any great effort.

Not only the indirect fraction of light but also the direct fraction of light are each extracted from the luminaire head so that virtually only one light horizon is perceived. By a light horizon the plane is meant from which a fraction of light is extracted. This is what distinguishes the luminaire according to this invention from a system composed of ceiling-mounted luminaires and/or free-standing luminaires and traditional desk luminaires in which, for achieving a sufficient illumination of a room and workplace, several extraction planes exist and correspondingly several but at least two light horizons generally clearly spaced apart from each other are perceived.

In one embodiment of this invention, the second illuminants are arranged in a luminaire mounting, which is received in a seat formed on the luminaire head, wherein the luminaire mounting within the seat is pivotable about two axes perpendicular to each other. In this manner it is possible for a user to move the direct fraction of light in a desired position and thus achieve an optimum illumination of the workplace.

According to an alternative embodiment, the second illuminants are arranged in a common plane D, wherein the plane D is in parallel to the plane E of the first illuminants. Hence, the direct and the indirect fraction of light are extracted from two planes which are in parallel to each other and arranged at a short distance from each other. Here, it can be provided also that the direct fraction of light extracted by the second illuminants is radiated asymmetrically, wherein a maximum of radiation is in an angular range between 25° and 45°, preferably in an angular range between 30° and 40° with respect to a vertical to plane D. In other words, the direct fraction of light is in that case radiated as a widely radiating but asymmetric distribution. Here, the second illuminants can be arranged in a luminaire mounting which is rotatable about an axis extending perpendicularly to the planes E and D. In this manner, the maximum of asymmetric radiation can be directed by simple rotation of the luminaire mounting to different locations, for example, on a desk, without it being required that the luminaire as a whole must be moved and without it being required that the luminaire mounting must be pivoted out of plane D. The luminaire mounting can, for example, be formed as a flat disk which is located on an underside of the luminaire head.

In particular, the direct and the indirect fraction of light can be controlled independent of each other. Thus, in each case, it is also possible that only the indirect or only the direct fraction of light is extracted, if specific conditions so require, and the luminaire, for example, shall only be used as a room light or only as a workplace light. In particular, it is possible that both fractions of light are dimmable independent of each other and/or different light colors can be realized. Also, the color temperature can be continuously adjustable, for example, between a warm white color temperature in the range of approximately 3000 K and a cold white color temperature in the range of approximately 6000 K. In this manner, in particular an adjustment to daytime and seasonal changes of natural light is possible. Such an adjustment can be made by the user itself but it can also be carried out automatically by an appropriate sensor system. For this purpose, sensors can be provided detecting the current natural light conditions, and output a corresponding signal to the luminaire control depending on the values detected which luminaire control will then adjust the fraction of light to be extracted accordingly. A luminaire configured in this way adjusts itself to the biorhythm of a user predetermined by the natural light conditions in an optimum manner.

Control of the direct fraction of light can be made individually by the user in a wireless manner, for example, via a smartphone, a tablet computer or any other appropriate device for mobile communication by using the appropriate software. For this purpose, the luminaire control can comprise a radio interface, for example, a bluetooth interface. Alternatively or in addition, control can also occur via an appropriate control unit, for example, a touch panel, on the luminaire itself. Such a control unit can, for example, be integrated into the luminaire base.

According to another embodiment of this invention, the luminaire can have a user identification by which the direct fraction of light can be automatically adjusted depending on the user. Thus, for each user different light colors, light temperatures and/or dimming levels for the direct fraction of light can be stored which, when the respective user is identified by the user identification, are automatically adjusted. In particular, such data can also be stored depending on the season and the time of the day so that a direct fraction of light adapted to the daytime and seasonal changes of natural light can be automatically adjusted. In this way, the luminaire becomes a personalized luminaire.

The indirect fraction of light can also be adjusted by the individual user. According to this invention, however, it is provided that the indirect fraction of light is controlled centrally via a sensor system. This is based on the idea that the illumination of a room brought about by the indirect fraction of light shall not be capable of being influenced by the individual user but shall remain unchanged independent of the individually adjustable workplace illumination within a predetermined room area and time interval. The central control of the indirect fraction of light can, for example, occur via the technical building systems. Here as well, a daytime and a seasonal adjustment of the color temperature to natural light can occur, as described above for the direct fraction of light. Also dimming and/or adjustment of the light color is possible.

The luminaire can be made particularly energy-saving, if the indirect fraction of light is controlled by presence and/or daylight sensors such that the indirect fraction of light is only extracted, when actually individuals are in the room to be illuminated, and the luminaire is automatically switched off, when these individuals leave the room. The illuminance of the indirect fraction of light can be adjusted upward or downward as a function of the brightness of daylight detected. An indirect fraction of light controllable in such a manner can be used for fulfillment of ecological building standards such as, for example, the LEED standards or the green building program.

According to this invention, the luminaire can be configured as a table luminaire with a total height of approx. 60 to 70 cm. Such a luminaire is extremely mobile and easy to handle.

According to another embodiment of this invention, the luminaire is adjustable in height. Height adjustability means here that the height of the luminaire head is adjustable above a floor or above a table top. Such a height adjustability of the luminaire head permits to adjust the luminaire head as a function of the size of a user such that a user sitting at a table will not perceive any luminous surfaces on the luminaire, neither with respect to an indirect radiation nor with respect to a possible direct radiation. Height adjustability can here be typically within a range of approximately 10 to 20 cm by which the luminaire head can be adjusted in height so that different body heights can be taken into account. Preferably, height adjustability is approximately 15 cm. Height adjustability can, for example, be realized by a telescopic mechanism formed on the luminaire stand.

In one embodiment of this invention, the luminaire head is fastened to the luminaire stand in a pivotable manner. Different adjustment angles of the luminaire head and thus different radiation directions of the light can be realized as a result.

BRIEF DESCRIPTION OF THE DRAWINGS

Below, this invention is explained more in detail by examples and with reference to the attached drawings, wherein.

DETAILED DESCRIPTION OF INVENTION

Figure 1:
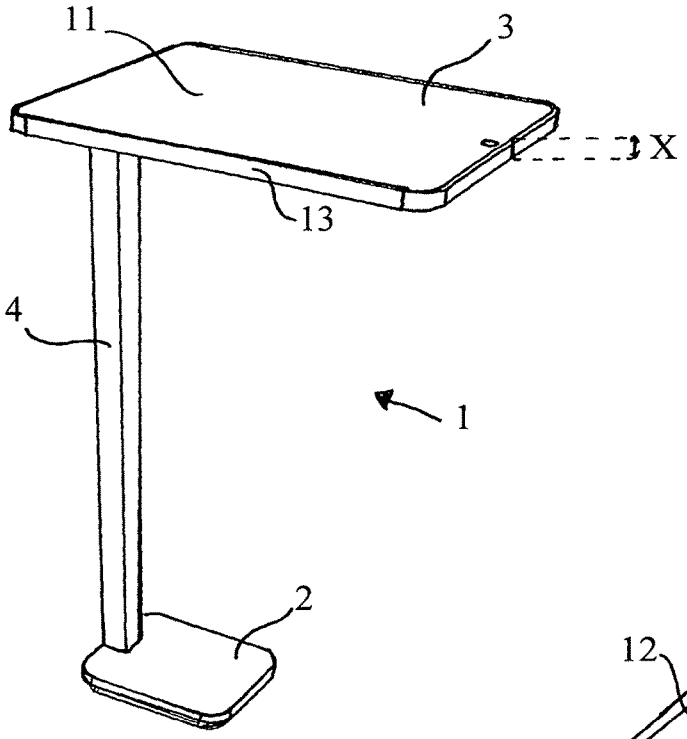
FIG. 1 shows an embodiment of a luminaire according to this invention in a perspective view diagonally from above.

FIG. 1 shows a luminaire designated generally with 1, comprising a luminaire base 2, a luminaire head 3 and a luminaire stand 4 extending between the luminaire base 2 and the luminaire head 3. The luminaire 1 is configured as a table luminaire and can be positioned with its luminaire base 2 on a table, for example, on a desk. The luminaire head 3 is cuboid-shaped and comprises an upper side 11, an underside 12 in parallel to the upper side 11, wherein the underside 12 is facing the luminaire base 2, and a circumferential border 13 arranged between the upper side 11 and the underside 12. The distance X between the upper side 11 and the underside 12 is 1.4 cm. The entire luminaire 1 has a height of approximately 66 cm.

The upper side 11 of the luminaire head 3 can be made of a transparent material, for example, of glass or any suitable, translucent plastic material. The upper side 11 is not part of the glare suppression arrangement which is explained below. In a gap between the upper side 11 and the underside 12 of the luminaire head 3, first illuminants 5 are arranged in a plane E in parallel to the upper side 11 and/or the underside 12, as shown in sectional views of FIGS. 3 to 5. The first illuminants 5 are light-emitting diodes (LEDs) which are arranged on a common circuit board. In the luminaire head 3, LEDs are arranged in parallel rows. The light of the LEDs is radiated upwards as an indirect fraction of light 6 through the transparent upper side 11 of the luminaire head 3. The LEDs are selected so that via the indirect fraction of light 6, a mean illuminance of about 300 Lux can be achieved at a workplace, for example, on a desk. In any case, the luminaire 1 is suitable to illuminate a workplace, for example, a desk, according to standard DIN EN 12465/1.

Figure 4:
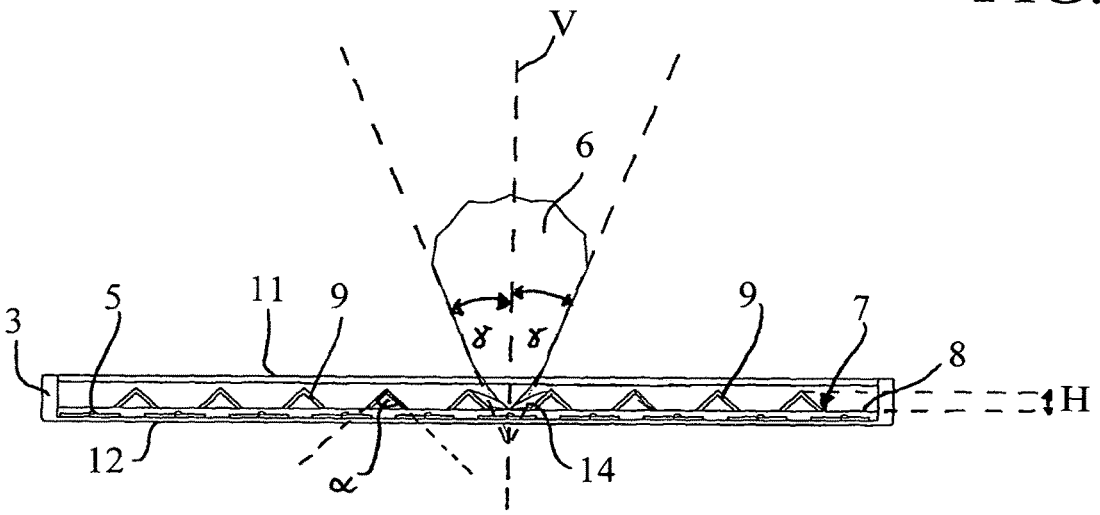
FIG. 4 shows the representation from FIG. 3 but with an exemplary radiation characteristic of an illuminant when the shielding elements are inserted.
Figure 5:
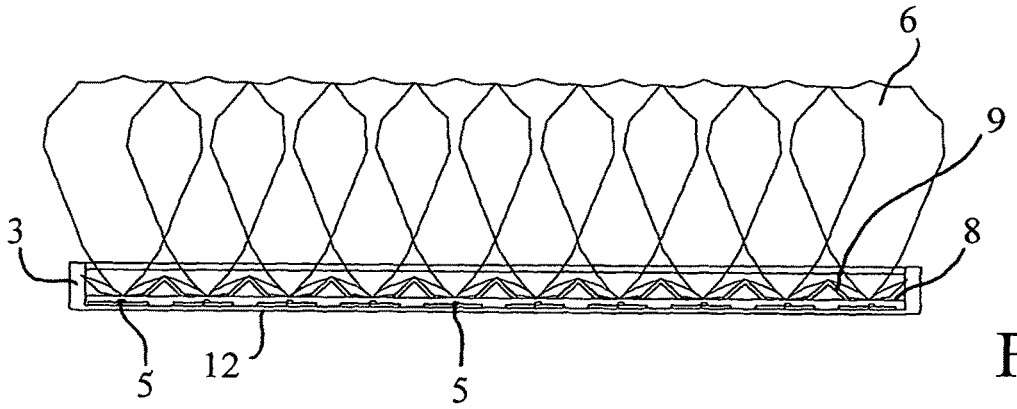
FIG. 5 shows the representation from FIG. 4, wherein the radiation characteristics are shown for all illuminants.

Apart from the first illuminants 5, also a glare suppression arrangement 7 is arranged in the gap between the upper side 11 and the underside 12 of the luminaire head 3, as shown in FIGS. 4 and 5. The glare suppression arrangement 7 is arranged in parallel to the plane E and/or the upper side 11 and the underside 12 of the luminaire head 3, and comprises a light-directing foil 8 and shielding elements 9. The glare suppression arrangement 7 has a height (H) of 0.6 cm. By an arrangement of the glare suppression arrangement 7 in parallel to the plane E is meant that the glare suppression arrangement 7 as a whole is aligned in parallel to the plane E, even if inside the glare suppression arrangement 7 individual elements, such as, for example, the individual shielding elements 7, include a particular angle other than zero with the plane E. The light-directing foil 8 is arranged between the first illuminants 5 and the shielding elements 9 with a distance of only approximately 1 mm from the first illuminants 5. The light-directing foil 8 has a microstructure which filters the light radiated from the first illuminants 5. Here, the microstructure is configured so that light beams emitted by the first illuminants 5 pass through the foil 8 only in a defined angular range, whereas light beams outside said angular range are reflected. The foil 8 can, for example, be a light-directing foil of the Focus line developed by Polyscale GmbH.

Figure 3:
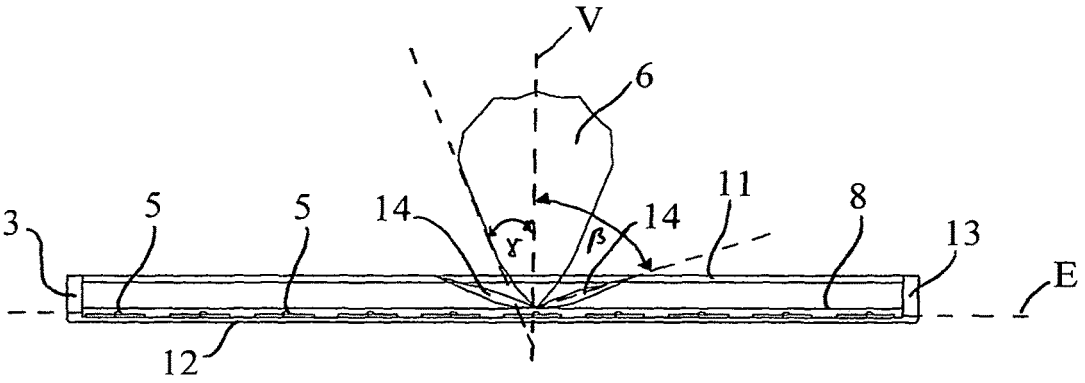
FIG. 3 shows a section taken through the luminaire head of the luminaire from FIGS. 1 and 2 with an exemplary radiation characteristic of an illuminant when the shielding elements are removed.

FIG. 3 shows the effect of the light-directing foil 8 on the radiation characteristic of a first illuminant 5. For better understanding of the operating principle of the glare suppression arrangement, in the representation of FIG. 3 the shielding elements 9 are deliberately omitted. After passage through the light-directing foil 8, the light of a first illuminant 5 is radiated substantially into two angular ranges: the major portion is radiated as an indirect fraction of light 6 into an angular range $\gamma$ between 0° and approximately 20° with respect to the vertical V, another small fraction of light 14 is radiated at an angle $\beta$ of approximately 70° with respect to the vertical V.

When the luminaire 1 is used as a table luminaire with a luminaire head according to the representation in FIG. 3, that means, without shielding elements, a standing viewer would be dazzled by the fraction of light 14 since the luminaire head 3 at a total height of the luminaire 1 of approximately 66 cm and a mean table height of 72 cm is positioned at a height of approximately 138 cm above the floor and thus generally below the eye level of a standing viewer.

In order to prevent this, the luminaire 1 according to this invention comprises in addition to the light-directing foil 8, shielding elements 9 made of metal or plastic, as shown in FIG. 4. It can be seen from FIG. 4 that the fraction of light 14 by the shielding elements 9 arranged between the light-directing foil 8 and the upper side 11 of the luminaire head 3 is shielded so that ultimately only the indirect fraction of light 6 emits from the luminaire head 3. The shielding elements 9 are positioned in parallel rows and offset from the rows of the first illuminants 5 so that the fractions of light 14 emitted from the first illuminants 5 under flat angles $\beta$ are shielded by the shielding elements 9 and are not emitted under flat angles $\beta$ from the luminaire head 3. The dimensions of the shielding elements 9, in particular their height, are aligned here with the precise radiation direction of the fractions of light 14. At the same time, the shielding elements 9 are configured and arranged so that they do not influence in any way the indirect fraction of light 6 radiated within the angular range $\gamma$. In the embodiment shown, the shielding elements 9 are configured as webs with triangular cross section, wherein the height of the individual webs is approximately 5 mm. The angle $\alpha$ formed by the two flanks of a web is 62°.

Hence, the light emitted by the first illuminants 5, after passage through the glare suppression arrangement 7, exits the luminaire head 3 under a beam spread $\gamma$ which is limited with respect to the vertical V to approximately 20°. Even at a height of the luminaire head 3 of only approximately 138 cm above the floor, a glare of the standing viewer at simultaneous powerful light extraction is avoided in this way.

Figure 2:
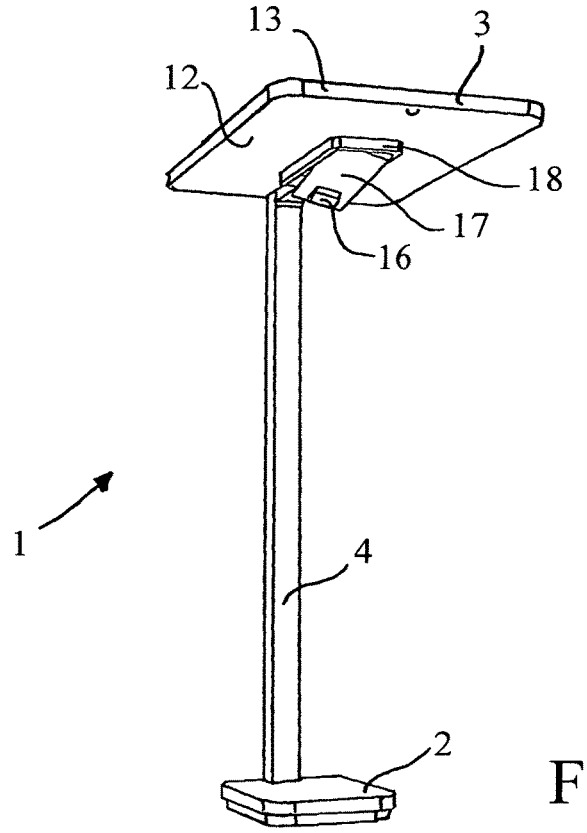
FIG. 2 shows the luminaire from FIG. 1 in another perspective view diagonally from below.

As shown in FIG. 2, the luminaire 1 comprises second illuminants 16 apart from the first illuminants 5 which second illuminants 16 are arranged in a luminaire mounting 17. The luminaire mounting 17 is received in a seat 18 formed in the area of its underside 12, and is pivotable relative to the seat 18 about two axes. The second illuminants 16 extract a second fraction of light, not shown here, which is radiated as a direct fraction of light downwards, for example, in the direction of a working surface. Due to pivotability of the luminaire mounting 17, a user can adjust the second, direct fraction of light according to its respective requirements.

Figure 6:
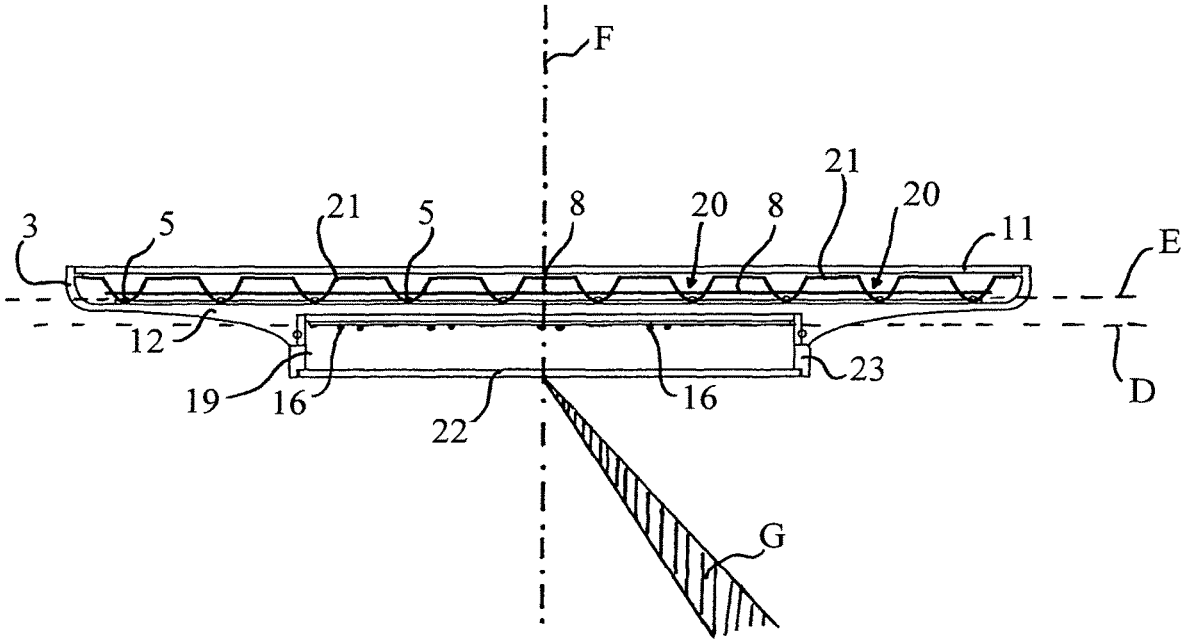
FIG. 6 shows a section taken through a luminaire head in an alternative embodiment.

FIG. 6 shows an alternative embodiment of the luminaire head 3, wherein the same reference numerals correspond to the same components. In the sectional view shown here, the shielding elements 9 are not visible. The first illuminants 5 are arranged below the light-directing foil 8. Each first illuminant 5 is arranged in a mixing chamber 20, wherein the mixing chambers 20 are formed of an arrangement of plastic webs 21 made of a highly reflective plastic material. The mixing chambers 20 have the function of reflecting light beams which, starting from the first illuminants 5, strike the light-directing foil 8, and are not within the angular range requested for passage and are therefore being reflected by the foil 8, again in the direction of the foil 8. If need be, this process is repeated several times until the radiation finally strikes the foil 8 in the angular range requested for the passage and can pass through the same.

The embodiment of FIG. 6 shows second illuminants 6 for radiation of a direct fraction of light. The second illuminants 16 are arranged in a common plane D which is parallel to plane E of the first illuminants 5. By the second illuminants 16, a direct fraction of light can be radiated substantially downwards, as shown in the representation of FIG. 6. Here, the illuminants 16 and an optical system 22 covering them are configured such that the direct fraction of light is radiated as a widely radiating distribution, not shown here, but asymmetrically, wherein a maximum of radiation is radiated in an angular range between 30° and 40° with respect to an axis F. The angular range, in which the maximum of radiation is located, is suggested in FIG. 6 as a hatched surface G schematically starting from a point on the optical system 22. The axis F extends perpendicularly to the planes E and D. The illuminants 16 are arranged in a luminaire mounting 19 which is formed as a flat, rotatable disk on the underside 12 of the luminaire head. The disk-shaped luminaire mounting 19 is rotatable about the axis F, wherein a user for this purpose can grasp an outer ring 23 of the luminaire mounting 19 and can rotate the luminaire mounting 19 relative to the luminaire head 3. As one can easily see, the maximum of radiation of the direct fraction of light can thereby be directed to another location without it being necessary that the luminaire must be moved or the second illuminants 16 must be pivoted out of the plane D located in parallel to the plane E.

The embodiment of FIG. 6 shows an embodiment of the luminaire according to this invention with mixing chambers 20 and with second illuminants 16 arranged in a luminaire mounting 19 formed as a rotatable disk. But in alternative embodiments of this invention, these two features can also be realized independent of each other, for example, in a combination with individual features of the alternative embodiment shown in the FIGS. 1 to 5.

The first illuminants 5 and the second illuminants 16 and thus the direct fraction of light and the indirect fraction of light 6 are controllable independent of each other, and that means the first and the second illuminants 5, 16 can be switched on and off independent of each other but they can also be dimmed and/or adjusted in their light color and/or color temperature independent of each other. The second illuminants 16 and thus the direct fraction of light can be controlled by the user in a wireless manner, for example, via a smartphone or any other suitable device for mobile communication. The first illuminants 5 are controlled via technical building systems, wherein signals of presence and/or daylight sensors are entered into the control system for this purpose.

The luminaire 1 is suitable as a small, table-mounted luminaire to generate not only a strong, indirect room lighting but also a direct workplace illumination, wherein a glare of standing viewers is effectively prevented due to the specific glare suppression arrangement. The luminaire 1 is characterized above all by the fact that as a smaller, mobile luminaire it can be used in a very flexible manner, and can be repositioned time and again without any great effort. Furthermore, it reduces the number of light horizons compared with conventional lighting systems made of ceiling luminaires or free-standing luminaires in combination with desk luminaires, because not only the indirect fraction of light 6 but also the direct fraction of light are radiated from one single plane defined by the luminaire head 3. Finally, the extremely low height H of the glare suppression arrangement 7 permits a correspondingly flat design of the luminaire head 3, whereby the luminaire also satisfies the requirement of a reduced, modern design.

The invention claimed is:

1. A luminaire (1), comprising a luminaire base (2), a luminaire head (3) and a luminaire stand (4) extending between the luminaire base (2) and the luminaire head (3), wherein the luminaire head (3) comprises first illuminants (5), which are arranged in a common plane (E), and which are adapted to extract a first, indirect fraction of light (6), and wherein the luminaire head (3) comprises a glare suppression arrangement (7), wherein the glare suppression arrangement (7) is arranged parallel to the plane (E) and comprises a light-directing foil (8) and shielding elements (9), wherein the shielding elements (9) are arranged so that a beam spread (γ) of the indirect fraction of light (6) after passage through the glare suppression arrangement (7) is limited to 30° with respect to a vertical (V) to the plane (E), and wherein the glare suppression arrangement (7) in a direction of the vertical (V) has a maximum height (H) of 2.0 cm.

2. The luminaire (1) according to claim 1, wherein the beam spread (γ) of the indirect fraction of light (6) after passage through the glare suppression arrangement (7) is limited to 22° with respect to the vertical (V) to plane (E).

3. The luminaire (1) according to claim 2, wherein the glare suppression arrangement (7) in the direction of the vertical (V) has a maximum height (H) of 0.8 cm.

4. The luminaire (1) according to claim 3, wherein each first illuminant (5) is arranged in a mixing chamber (20).

5. The luminaire (1) according to claim 4, wherein the luminaire head (3) comprises second illuminants (16) for extraction of a second, direct fraction of light.

6. The luminaire (1) according to claim 5 wherein the second illuminants (16) are arranged in a luminaire mounting (17), which is received in a seat (18) formed on the luminaire head (3), wherein the luminaire mounting (17) is pivotable about two axes perpendicular to each other relative to the seat (18).

7. The luminaire (1) according to claim 5, wherein the second illuminants (16) are arranged in a common plane (D), wherein the plane (D) is in parallel to the plane (E) of the first illuminants (5).

8. The luminaire (1) according to claim 7, wherein the direct fraction of light extracted by the second illuminants (16) is radiated asymmetrically, wherein a maximum of radiation is in an angular range between 25° and 45° with respect to a vertical to plane (D).

9. The luminaire (1) according to claim 8, wherein the second illuminants (16) are arranged in a luminaire mounting (19) which is rotatable about an axis (F) extending perpendicularly to the planes (E) and (D).

10. The luminaire (1) according to claim 9, wherein the direct fraction of light and the indirect fraction of light (6) are controllable independent of each other.

11. The luminaire (1) according claim 10, wherein the luminaire (1) has a user identification by means of which the direct fraction of light can be automatically adjusted depending on the user.

12. The luminaire (1) according to claim 11, wherein the indirect fraction of light (6) is controllable via a sensor system.

13. Luminaire (1) according to claim 12, wherein the luminaire (1) is formed as a table luminaire and comprises has a total height of 60 cm to 70 cm.

14. The luminaire (1) according to claim 13, wherein the luminaire (1) is adjustable in height.

15. The luminaire (1) according to claim 14, wherein the luminaire head (3) is cuboid-shaped.

16. The luminaire (1) according to claim 15 wherein the cuboid-shaped luminaire head (3) has a length between 20 cm and 40 cm and a height between 20 cm and 30 cm.

17. The luminaire (1) according to claim 16, wherein the luminaire head (3) is fastened to the luminaire stand (4) in a pivotable manner.

18. The luminaire (1) according to claim 1, wherein the glare suppression arrangement (7) in the direction of the vertical (V) has a maximum height (H) of 0.8 cm.

19. The luminaire (1) according to claim 1, wherein each first illuminant (5) is arranged in a mixing chamber (20).

20. The luminaire (1) according to claim 1, wherein the luminaire head (3) comprises second illuminants (16) for extraction of a second, direct fraction of light.

21. The luminaire (1) according to claim 7, wherein the second illuminants (16) are arranged in a luminaire mounting (19) which is rotatable about an axis (F) extending perpendicularly to the planes (E) and (D).

22. The luminaire (1) according to claim 5, wherein the direct fraction of light and the indirect fraction of light (6) are controllable independent of each other.

23. The luminaire (1) according to claim 5, wherein the luminaire (1) has a user identification by which the direct fraction of light can be automatically adjusted depending on the user.

24. The luminaire (1) according to claim 1, wherein the indirect fraction of light (6) is controllable via a sensor system.

25. Luminaire (1) according to claim 1, wherein the luminaire (1) is formed as a table luminaire and has a total height of 60 cm to 70 cm.

26. The luminaire (1) according to claim 1, wherein the luminaire (1) is adjustable in height.

27. The luminaire (1) according to claim 1, wherein the luminaire head (3) is cuboid-shaped.

28. The luminaire (1) according to claim 1, wherein the luminaire head (3) is fastened to the luminaire stand (4) in a pivotable manner.

* * * * *